US008231208B2

(12) United States Patent
Kawase et al.

(10) Patent No.: US 8,231,208 B2
(45) Date of Patent: Jul. 31, 2012

(54) LIQUID EJECTION HEAD

(75) Inventors: Junya Kawase, Yokohama (JP); Shinji Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1061 days.

(21) Appl. No.: 12/060,025

(22) Filed: Mar. 31, 2008

(65) Prior Publication Data

US 2008/0246804 A1 Oct. 9, 2008

(30) Foreign Application Priority Data

Apr. 3, 2007 (JP) ..... 2007-097716

(51) Int. Cl.
*B41J 2/18* (2006.01)

(52) U.S. Cl. ..... 347/84

(58) Field of Classification Search ..... 347/84
See application file for complete search history.

(56) References Cited

U.S. PATENT DOCUMENTS 7,205,097 B2 * 4/2007 Fukunaga et al. ..... 430/320

FOREIGN PATENT DOCUMENTS

JP 06-008446 A 1/1994

* cited by examiner

*Primary Examiner* — Jerry Rahll
(74) *Attorney, Agent, or Firm* — Canon USA Inc IP Division

(57) ABSTRACT

A liquid ejection head which does not stop a printing action even if mist of ink adheres onto the orifice plate, particularly between ejection port arrays, and suppresses deposition of continuously-adhered mist of ink. On the printing head part, there is formed a recovery hole which communicates with the common liquid chamber and recovers the ink adhered onto the orifice plate in the printing head part into the common liquid chamber. A face is provided with function of an ink guide in the printing head part so as the ink adhered to the printing head part to be guided to the recovery hole.

3 Claims, 13 Drawing Sheets

LIQUID EJECTION HEAD

BACKGROUND OF THE INVENTION

1. Field of the Invention

The present invention relates to a liquid ejection head capable of ejecting a liquid through an ejection port, specifically relates to a structure of a liquid ejection head suitable for removing the liquid adhered to a face of the liquid ejection head, provided with the ejection port, (hereinafter referred to as the "ejection face").

2. Description of the Related Art

An ink jet printing apparatus which forms an image on a printing medium using a liquid ejection head may generate fine ink droplets which do not land on the printing medium. These fine ink droplets become ink mist that floats between the liquid ejection head and the printing medium. Thus, there is a problem that the ink mist adheres, in some cases, particularly to an orifice plate which is a member forming the ejection face of the liquid ejection heads. FIG. 13 shows a schematic drawing illustrating the adhered state of ink onto the orifice plate. According to the orifice plate shown in FIG. 13, there are two parallel arrays of ejection ports, and ink adheres to the periphery of the ejection ports.

As illustrated in FIG. 13, the ink ejected from the liquid ejection head and adhering to the orifice plate is largely grouped into two kinds depending on the adhesion zone. That is, one is the mist in the adhesion zone in a lip shape adhering surrounding the ejection port array, (hereinafter referred to as the "lip mist"), and the other is the mist in the adhesion zone adhering between the two arrays of ejection ports, (hereinafter referred to as the "mist between ejection port arrays").

For the ink adhering onto the orifice plate of the liquid ejection head as described above, a printing apparatus of serial scan type commonly removes the adhered ink by cleaning action that wipes the ejection face. The printing apparatus of serial scan type is a printing apparatus which forms an image by ejecting the liquid from the liquid ejection head while scanning the liquid ejection head in the direction perpendicular to the direction of conveying the printing medium. A cleaner removes the deposited ink by wiping the orifice plate on which the mist accumulates using a wiper blade member on a rubber plate. When cleaning of the liquid ejection head is performed, the printing action is temporarily stopped cleaning.

There are available ink jet printing apparatuses that improve printing speed by increasing the size of the liquid ejection head, or widening the range of arrangement of ejection port arrays, thus decreasing the scanning cycles of the liquid ejection head. Furthermore, as disclosed in Japanese Patent Laid-Open No. 6-008446 (1994), there is a full-line printing type which performs image-forming while the printing medium is conveyed against the fixed liquid ejection head on which the ejection ports are arranged over the range corresponding to the width of the printing medium.

Under the condition that the ejection port array is elongated as described above, the cleaning to remove the adhered mist accumulated during the printing action takes a longer time for a single cleaning cycle. This leads to the increase in the period of intermission of printing process, which is a problem on attaining high speed printing of the printing apparatus.

If the orifice plate is not cleaned in order to increase the speed of printing, the lip mist A and the mist between ejection port arrays B respectively accumulate, as illustrated in FIG. 13. When the respective depositions further increase, there is formed a puddle of ink as a result of connecting the lip mist A with the mist between ejection port arrays B overpassing the respective ejection port arrays. Covering the ejection port with the puddle of ink may prevent the ink from being ejected. Specifically, the mist between ejection port arrays B may affect the ink ejection performance even with a small amount of adhered mist, because generally the distance between the two ejection port arrays is small (normally 200 μm).

SUMMARY OF THE INVENTION

The present invention is directed to a liquid ejection head which does not stop a printing action even if mist of ink adheres onto the orifice plate, particularly between ejection port arrays, and suppresses deposition of continuously-adhered mist of ink, and to a liquid ejection head which prevents defective phenomenon of plugging the ejection port resulted from the deposition of ink mist.

According to a first aspect of the present invention, there is provided a liquid ejection head which includes: an ejection port facilitating ejecting a liquid; a liquid chamber communicating with the ejection port and configured to contain the liquid to be supplied to the ejection port; and a recovery hole formed in a face on which the ejection port is formed. The recovery hole communicates with the liquid chamber. The liquid adhered to the face is recovered into the liquid chamber through the recovery hole by negative pressure existing in the liquid chamber.

According to the liquid ejection head of the present invention, since there is a recovery hole communicating with the common liquid chamber, formed in the liquid ejection head, the liquid can be recovered through the recovery hole even when the liquid adheres onto the ejection face. Consequently, the adhesion and deposition of the liquid onto the liquid ejection head is effectively suppressed without frequent intermission of printing action for recovery action of the liquid ejection head, thereby allowing the printing head to increase the speed of printing action.

Also, since the ejection face can be kept clean without frequent recovery action, the device used for the recovery action can be eliminated, which allows the printing apparatus to become small.

Furthermore, it becomes possible that the liquid adhered to the liquid ejection head is recovered in the liquid chamber, and that the recovered liquid is reused. Consequently, the consumption of liquid at the liquid ejection head becomes small, and the use cost thereof can be suppressed. Accompanied with the recovery of liquid, the amount of waste ink becomes small, which decreases the load to environment, thus providing the environmentally friendly liquid ejection head.

Further features of the present invention will become apparent from the following description of exemplary embodiments (with reference to the attached drawings).

DESCRIPTION OF THE EMBODIMENTS

Figure 1:
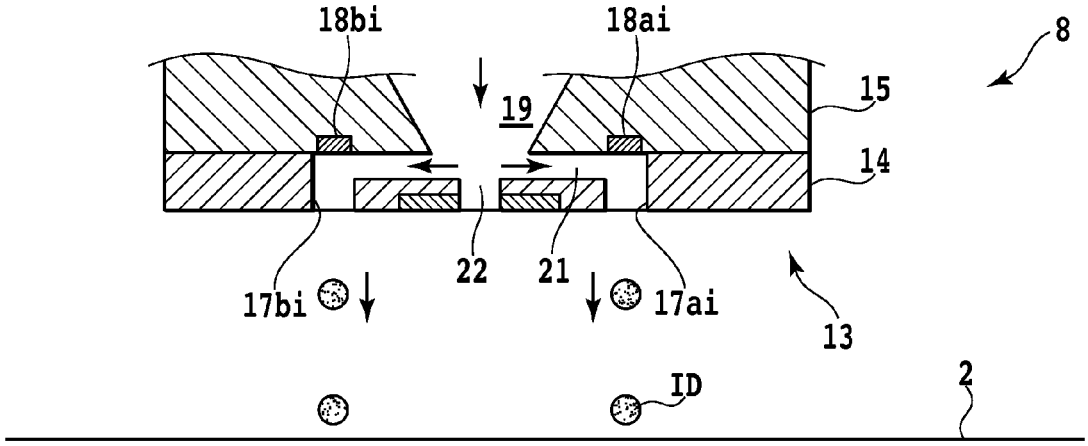
FIG. 1 shows a cross sectional view of a printing head part according to a first embodiment of the present invention.

Embodiments of the present invention will be described below by referring to the drawings.

(First Embodiment)

Figure 10:
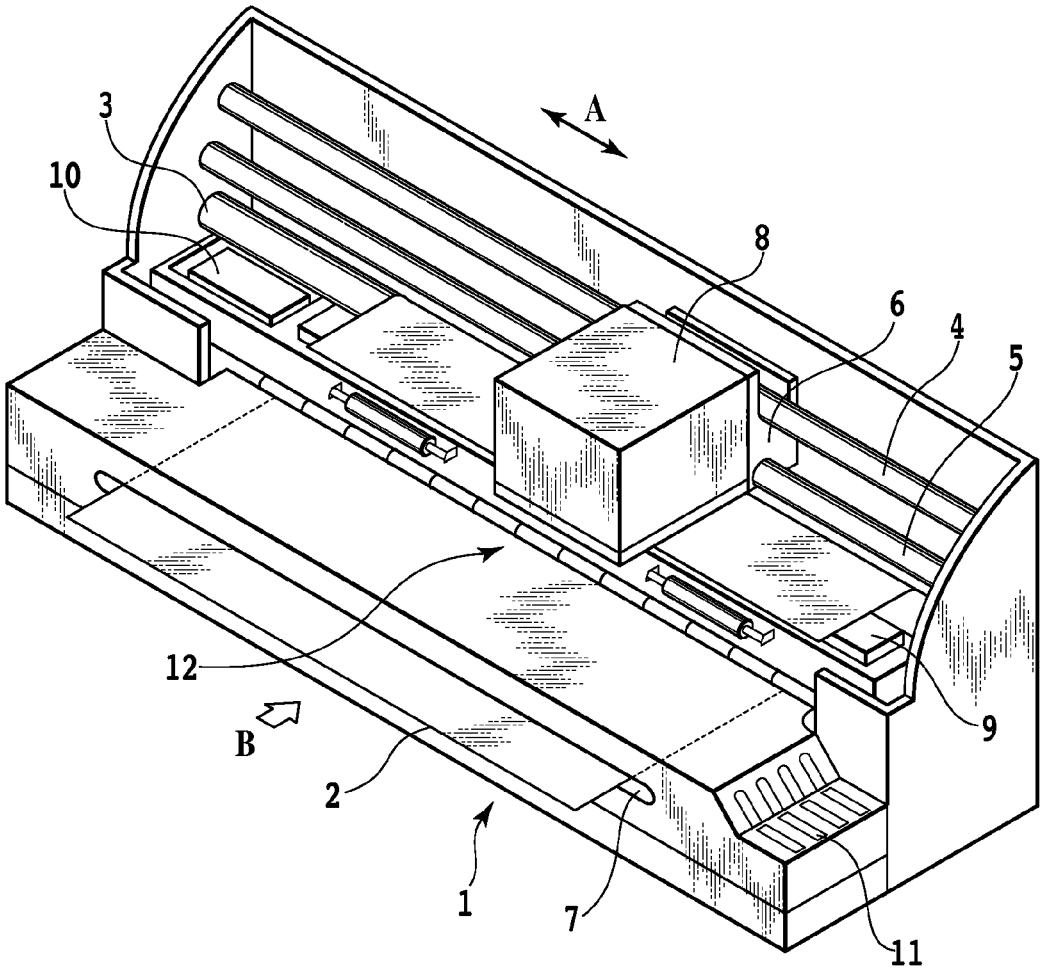
FIG. 10 shows a perspective view of a printing apparatus equipped with a head cartridge applying the printing head part of FIG. 1.

FIG. 10 shows a perspective view of an ink jet printing apparatus 1 according to the first embodiment of the present invention. A printing medium 2 is inserted at the position where the printing medium is conveyed of the ink jet printing apparatus 1. The printing medium 2 is conveyed by a transfer roller 3. The printing apparatus 1 of the first embodiment is a serial scan type printing apparatus, and a carriage 6 is guided in free-moving mode in a main scanning direction (along the direction of arrow A) by guide shafts 4 and 5. The carriage 6 moves in a reciprocating manner in the main scanning direction using a carriage motor (not shown) and a driving force transmission mechanism (not shown) which transmits the driving force of the carriage motor. A plurality of head cartridges 8, which eject the respective inks of a plurality of colors, is equipped in the carriage 6. The plurality of ink colors may be four colors of black (Bk), cyan (C), magenta (M), and yellow (Y). Corresponding to these four colors, the first embodiment uses four color head cartridges.

Figure 11:
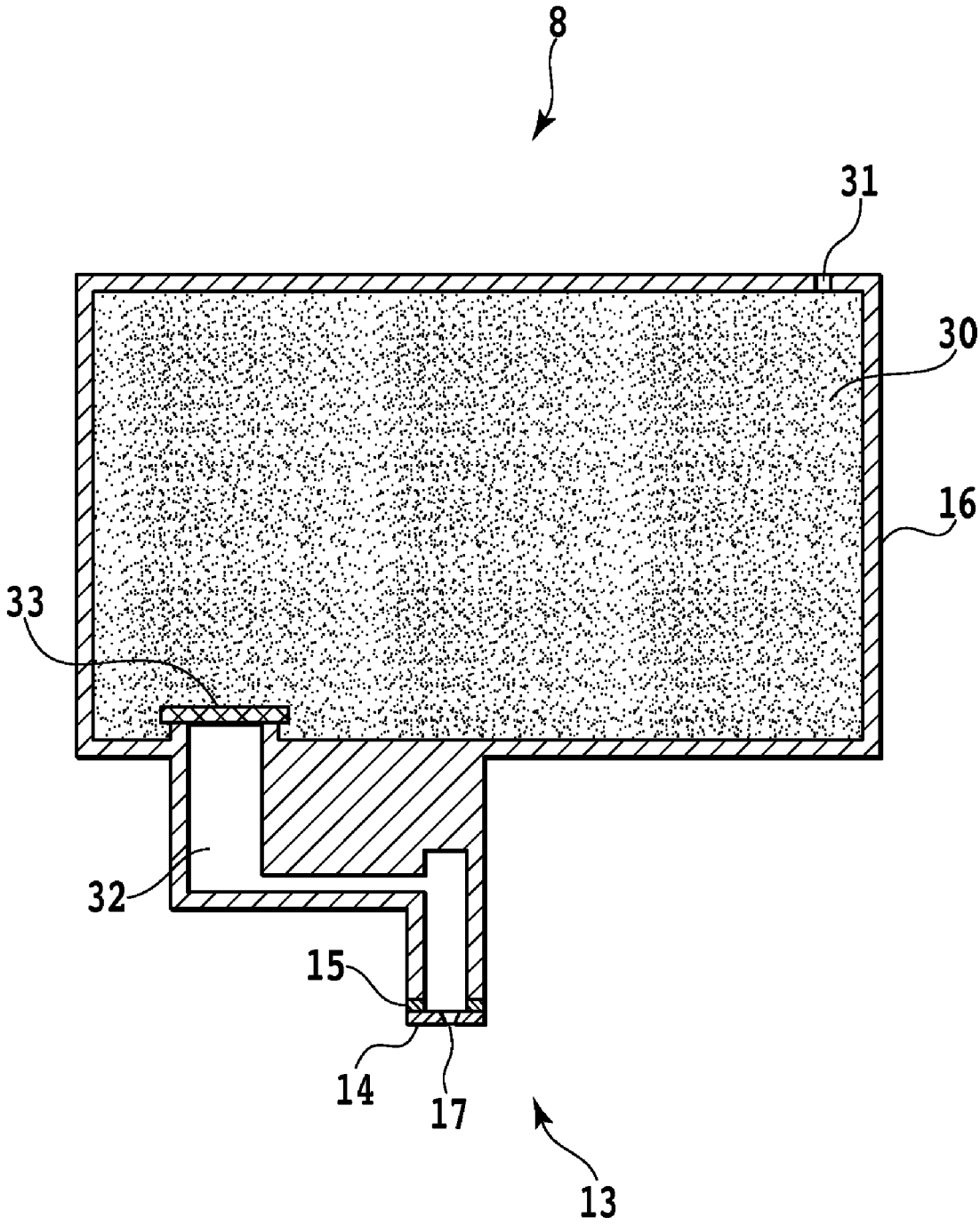
FIG. 11 shows a cross sectional view of the head cartridge applying the printing head part of FIG. 1.

FIG. 11 shows a cross sectional view of one of the head cartridges supporting one of the four colors. The head cartridge 8 in the first embodiment has a printing head part (liquid ejection head) 13 and a tank part 16 functioning as the ink supply source integrally with the printing head part 13. The tank part 16 contains a porous body 30, and the porous body 30 is filled with ink absorbed therein. The porous body 30 can be a sponge having a fine cell structure. On the wall at upper portion of the tank part 16, there is formed an atmospheric communicating port 31 which allows the inside of the tank part 16 to communicate with the atmosphere. Between the tank part 16 and the printing head part 13, there is formed an ink flow path 32 which allows communication therebetween. At the opening part where the tank part 16 communicates with the ink flow path 32, there is positioned a filter 33 for filtering the ink flowing through the ink flow path 32.

Since the tank part 16 contains the porous body 30 and the porous body 30 is filled with ink in impregnated state, the inside of the tank part 16 is under a negative pressure by the action of capillary force generated in the porous body 30. Since the tank part 16 communicates with the ink flow path 32, the ink flow path 32 and the printing head part 13 are subjected to negative pressure.

Figure 12:
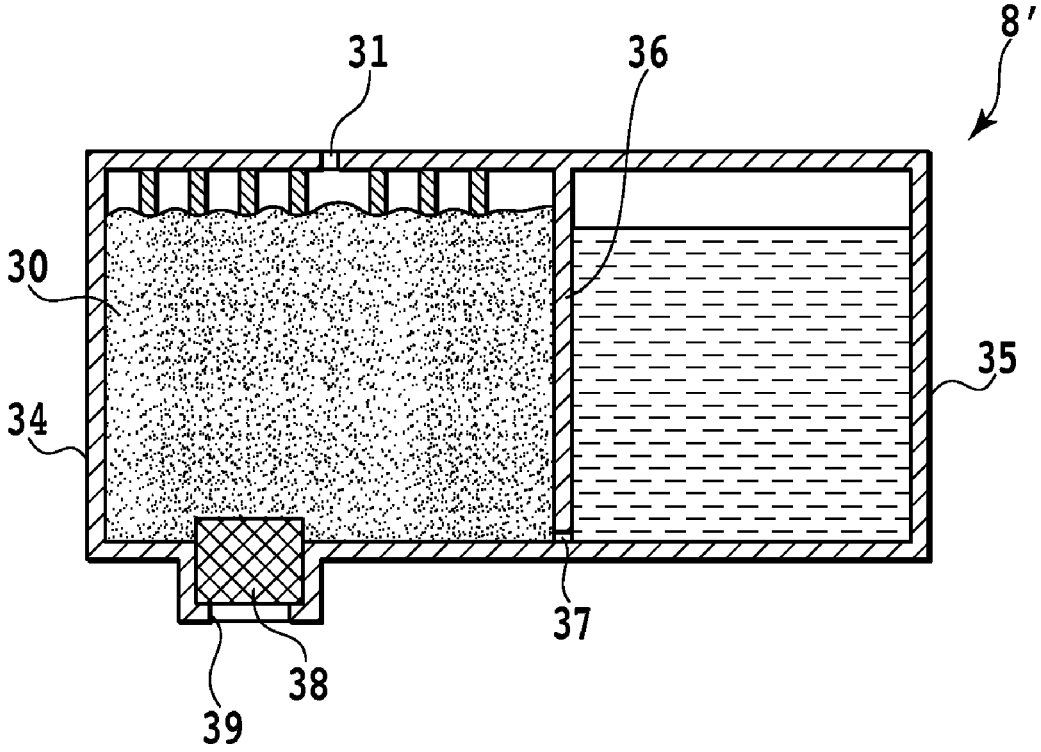
FIG. 12 shows a cross sectional view of an ink tank relating to still another embodiment.
Figure 13:
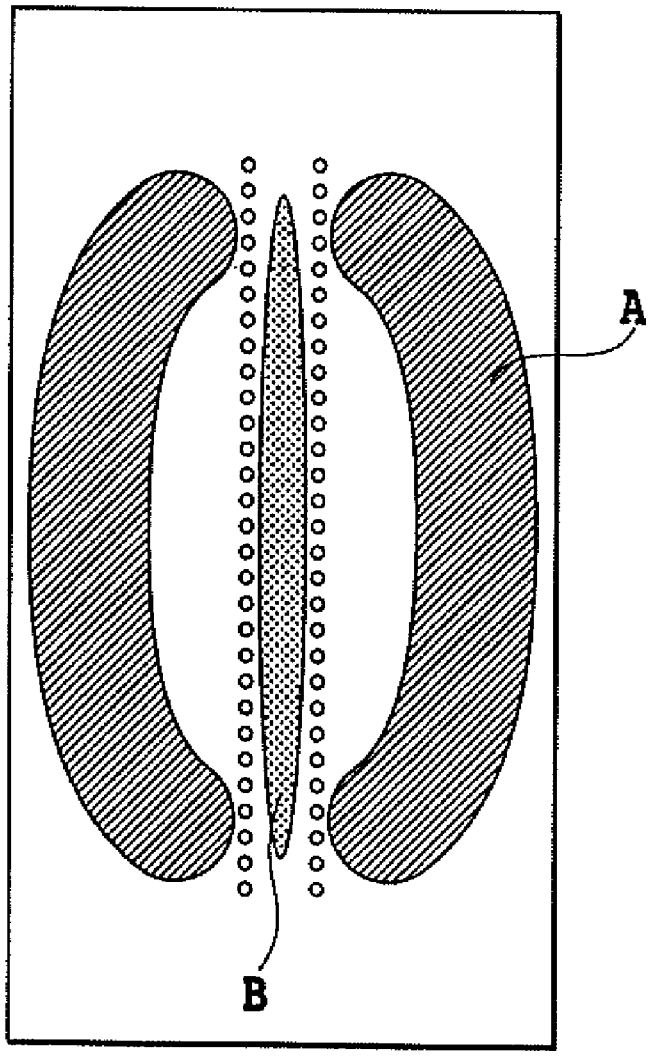
FIG.13 (PRIOR ART)
FIG. 13 shows a plan view of the printing head part, illustrating the ink adhered to the conventional printing head part.

As for the ink tank such as the above-described tank part 16 which contains the ink to supply the ink to the printing head, there maybe applied an ink tank 8' of another embodiment, as shown in FIG. 12. The ink tank 8' shown in FIG. 12 forms an ink-holding part 35 which holds the ink as is, separate from a porous body-holding part 34 which contains the porous body 30. The porous body-holding part 34 and the ink-holding part 35 are formed by dividing the ink tank 8' into two chambers by a partition 36. These two chambers communicate with each other by opening the lower portion of the partition 36 to form a flow path 37, thereby the ink held in the ink-holding part 35 is supplied to the porous body-holding part 34. At the bottom face of the porous body-holding part 34, there is positioned a compressed body 38 which generates additional strong capillary force by compressing the porous body 30 and by compressing itself. At the bottom face of the compressed body 38, there is located an opening part 39 which opens so as to allow the porous body-holding part 34 to communicate with the ink flow path formed at the printing apparatus side when the ink tank 8' is mounted on the carriage of the printing apparatus. Consequently, the ink supplied to the porous body-holding part 34 from the ink-holding part 35 is supplied to the printing head of the printing apparatus through the compressed body 38.

The configuration of the printing head part and of the tank part is not limited to the above embodiment, and the printing head part and the tank part may have other configurations as long as they can apply a negative pressure to the printing head part. For example, the printing head part and the tank part may be in an integrated structure in an inseparable or separable state, or may be in a structure in which the tank part is located at a fixed position on a separate apparatus other than the printing head and both of them are in a state of fluid-communicated mode via a tube or the like. In this case, the printing head part and the tank part are arranged so that the liquid surface of the ink in the tank part is positioned at a lower position than the height of the ejection port of the printing head, the printing head can be subjected to a negative pressure.

Below the left end of the movable range of the carriage 6, a recovery unit 10 is positioned. During a non-printing period or the like, the recovery unit 10 caps the ejection port of the printing head part 13 of each head cartridge 8, thus conducting recovery action. The left end position is called a "home position" of each head cartridge.

The reference numeral 11 denotes an operating part, and the operating part 11 has a switch part and a display element part. The switch part is used for switching on/off of the power source of the ink jet printing apparatus, for setting various print modes, and the like. The display part is positioned to indicate the variety of conditions of the printing apparatus to the user.

The head cartridges, which eject the respective color inks Bk, C, M, and Y, are integrated into a head unit 12, and the head unit 12 is loaded onto the carriage 6.

Other than the above example, a head cartridge which is filled with the treatment liquid may be applied, and two head cartridges of the treatment liquid and of Bk may be combined into a single head unit. Furthermore, the cartridges of Bk, C, M, and Y may be separated into individual head units.

FIG. 1 shows a schematic cross sectional view of a main part of the head cartridge 8 according to the first embodiment. FIG. 1 is an enlarged view of the printing head part 13 in the head cartridge 8 of the first embodiment shown in FIG. 11.

Figure 2:
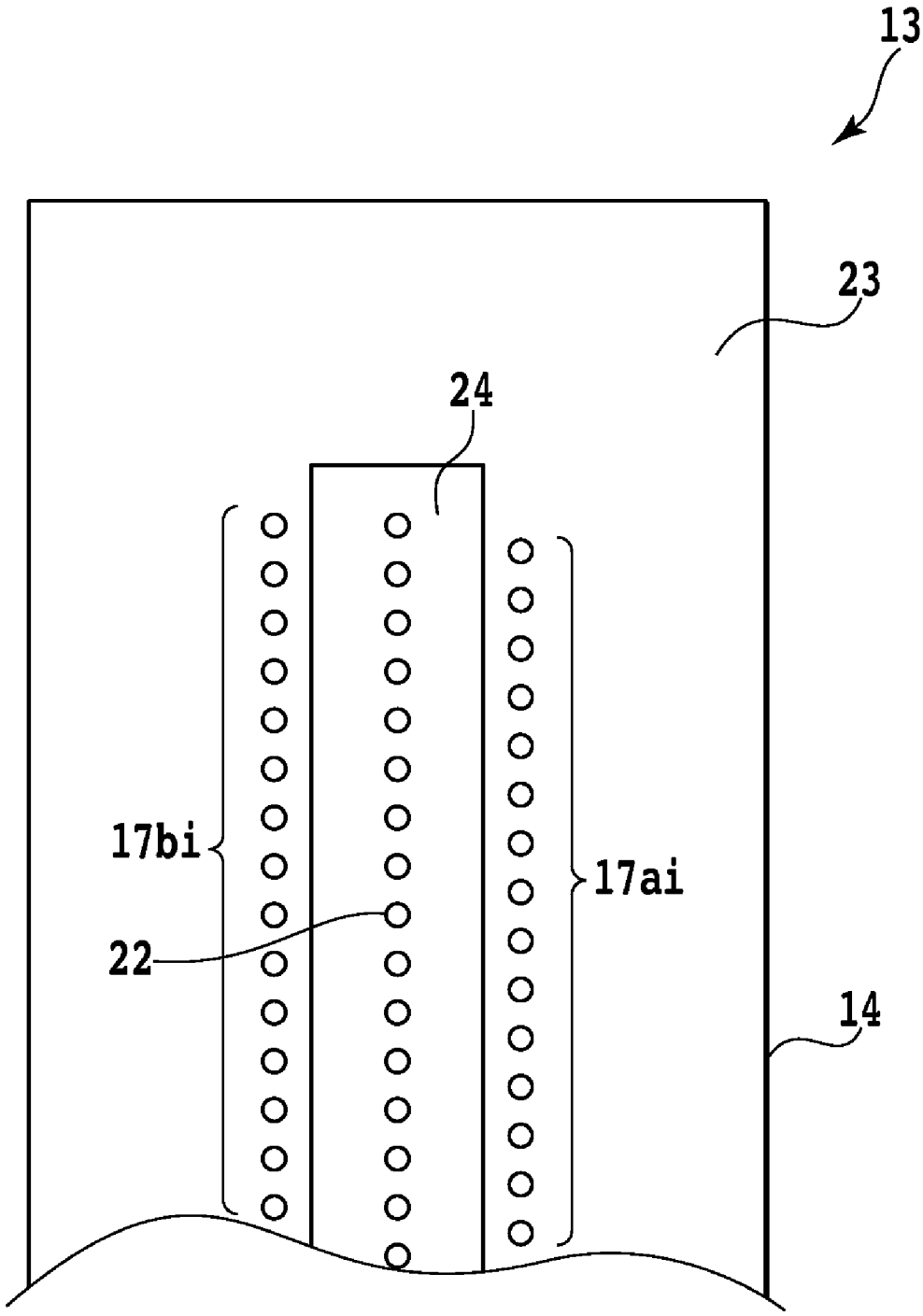
FIG. 2 shows a plan view of the printing head part of FIG. 1, viewed from a printing medium side.

FIG. 2 shows the plan view of the ejection face which is the face of the printing head part 13 in the head cartridge 8, opposite to the printing medium 2, of the first embodiment.

An orifice plate 14 has a plurality of ejection ports 17*ai* and 17*bi*, (i=1 to n, n is integer), each ejecting the ink to the printing medium 2. As shown in FIG. 2, the ejection ports 17*ai* and 17*bi* are formed in two arrays on the orifice plate 14. According to the first embodiment, the distance between the two arrays of ejection ports 17*ai* and 17*bi* is about 200 μm. The distance between the two arrays of ejection ports 17*ai* and 17*bi* is normally about 200 μm, and other distances may be applied.

Each array of the ejection ports 17*ai* and 17*bi* has an ejection port arrangement at a pixel density of half the nozzle resolution of the printing head part 13. In addition, the ejection ports 17*ai* and 17*bi* are arranged in a position of offsetting by a half pixel in the sub-scanning direction (in the direction of arrangement of the ejection port array) from each other, thus forming an image of a single color portion by both the ejection port arrays of the ejection ports 17*ai* and 17*bi*. The printing head part 13 in the first embodiment has 512 ejection ports at a 1200 dpi resolution, and each array of the ejection ports 17*ai* and 17*bi* has 256 ejection ports at a 300 dpi resolution pitch (42.3 μm). The ejection ports 17*ai* and 17*bi* are arranged in a staggered pattern offsetting from each other by a half pixel (21.16 μm) in the direction of arranging the ejection ports (in the sub-scanning direction).

The orifice plate 14 has a recovery hole 22 communicating with a common liquid chamber 21 described later on an ejection face of the printing head part 13 opposite to the printing medium 2. According to the first embodiment, a plurality of the recovery holes 22 is formed at a center part between the arrays of ejection ports 17*ai* and 17*bi*, which are the two arrays of ejection ports formed on the orifice plate of the printing head part 13. The recovery holes 22 are arranged in parallel with the ejection ports array 17*bi*, one of the ejection port arrays 17*ai* and 17*bi* arranged in a staggered manner.

On the ejection face of the orifice plate 14, there is specifically formed a water-repellent zone 23 which is subjected to water-repellent treatment coated by a water-repellent agent for shedding the adhering ink at the periphery of the ejection ports 17*ai* and 17*bi*. Typical water-repellent agents to form the water-repellent zone 23 include silicon-based resin and fluorine-based resin. A non-water-repellent zone 24, which is not subjected to water-repellent treatment, is formed at the periphery of the recovery holes 22 between the ejection port arrays 17*ai* and 17*bi*.

The ink held in the common liquid chamber 21 in the printing head part 13 is contained so that ink leakage is prevented during the period between when the ink is not being ejected by utilizing the negative pressure generated in the tank part 16 and when the meniscus force is generated inside the ejection port 17.

A printing element substrate 15 has an arrangement of heaters (heat-generating resistance part) 18*ai* and 18*bi* (i=1 to n, n is integer), as the energy-generating elements at positions opposite to the individual ink ejection ports 17*ai* and 17*bi* formed on the orifice plate 14. In addition, an ink supply port 19 through which the ink flows penetrating the printing element substrate 15 is formed. By joining the orifice plate 14 with the printing element substrate 15, the common liquid chamber (liquid chamber) 21 is formed therebetween.

As illustrated in FIG. 10, at printing, after the printing medium 2 is inserted into an insertion opening 7 located at the front edge part of the ink jet printing apparatus 1, the conveying direction thereof is reversed, and then the printing medium 2 is conveyed in the arrow B sub-scanning direction by the transfer roller 3. The ink jet printing apparatus 1 prints images sequentially on the printing medium 2 by repeating the printing action and the conveying action. In the printing action, the ink jet printing apparatus 1 ejects the ink toward the print zone of the printing medium 2 on a platen 9 while moving the head cartridge 8 in the main scanning direction. In the conveying action, the ink jet printing apparatus 1 conveys the printing medium 2 in the sub-scanning direction by a distance corresponding to the printing width in the printing action.

When the ink is ejected for printing, the ink held in the tank part 16 is supplied to the ink supply port 19 formed penetrating the printing element substrate 15 through the ink flow path 32, and then the ink is supplied into the common liquid chamber 21.

Each of the heaters 18*ai* and 18*bi* is controlled based on the driving pulse signal generated from a control part (not shown) corresponding to the image data of the image being printed on the printing medium 2. By the action, when the individual heaters 18*ai* and 18*bi* enter the action state, the ink is heated by each of the heaters 18*ai* and 18*bi*, and the ink droplet ID is ejected by the film-boiling phenomenon. Then, the ejected ink droplet ID lands the printing face of the printing medium 2.

At that moment, fine ink droplets which do not land on the printing medium 2 are generated, which fine ink droplets become ink mist that can adhere to the ejection face of the orifice plate 14 opposite to the printing medium 2. However, a negative pressure exists in the common liquid chamber 21, and the recovery hole 22 is formed being communicated with the common liquid chamber 21, which makes the pressure inside the recovery hole 22 decrease. As a result, the recovery hole 22 has a suction force to suck the ink adhered onto the orifice plate 14. Therefore, even when the fine ink droplets becoming the ink mist adhere to the ejection face opposite to the printing medium 2 on the orifice plate 14, the adhered ink is sucked by the suction force existing in the recovery hole 22 and is recovered into the common liquid chamber 21.

In the peripheral area of the recovery hole 22 between the ejection port arrays 17*ai* and 17*bi*, there is formed the non-water-repellent zone 24 where the water-repellent treatment is not given. In the zones other than the non-water-repellent zone 24 on the orifice plate 14 including the periphery of the ejection port arrays 17*ai* and 17*bi*, there is formed the water-repellent zone 23. Accordingly, when the ink is ejected from the ejection port 17, and when the ink mist of the ejected ink adheres to the periphery of the ejection port arrays 17*ai* and 17*bi*, the ink is attracted from the water-repellent zone 23 toward the non-water-repellent zone 24 because the difference in the wettability between the water-repellent zone 23 and the non-water-repellent zone 24 allows the ink to be drawn from the water-repellent zone 23 to the non-water-repellent zone 24.

Since the non-water-repellent zone 24 is not subjected to the water-repellent treatment, the non-water-repellent zone 24 has the ability to hold a certain amount of ink. Consequently, in the initial stage after locating the head cartridge 8 onto the carriage 6, the ink, which is drawn to the non-water-repellent zone 24, is held on the surface of the orifice plate 14. During the continued use of the head cartridge 8, when the ink continuously adheres to the non-water-repellent zone 24, the amount of ink adhered to the non-water-repellent zone 24 exceeds the ink holding capacity of the non-water-repellent zone 24. If the amount of ink adhered to the non-water-repellent zone 24 exceeds the ink holding capacity of the non-water-repellent zone 24, the ink floods over the non-water-repellent zone 24 and remains on the surface of the orifice plate 14. Once that situation appears, the ink becomes likely to move, not absorbed, on the non-water-repellent zone 24 and is likely drawn toward the recovery hole 22. When the ink adhering to the water-repellent zone 23 at the periphery of the ejection port 17 is drawn toward the non-water-repellent zone 24, the deposition of ink in a state of adhesion in the water-repellent zone 23 can be suppressed. Since the deposition of ink in the peripheral area of the ejection port 17 is suppressed, the clogging of the ejection port 17 by the deposited ink can be suppressed, and the state of being incapable of ejecting the ink from the ejection port 17 caused by plugging and the like can be prevented.

The ink drawn from the water-repellent zone 23 into the non-water-repellent zone 24 is sucked by the suction force of the recovery hole 22 formed in the non-water-repellent zone 24, and is recovered into the recovery hole 22. The ink mist adhered directly to the non-water-repellent zone 24 is also recovered by the recovery hole 22. The ink recovered into the recovery hole 22 again enters the common liquid chamber 21 and then is again ejected from the ejection port 17. Since the difference in the wettability between the water-repellent zone 23 and the non-water-repellent zone 24 guides the ink mist to the water-repellent zone 24, the respective non-water-repellent zone 24 and water-repellent zone 23 are formed so as to function as the ink-guide (function of liquid guide) to guide the ink.

According to the printing head part 13 in the first embodiment, the ink which adheres onto the orifice plate 14 can be recovered without recovery action such as wiping of the printing head part 13. As a result, it is able to simultaneously perform the printing action of the printing head part 13 and the recovery of ink adhering onto the orifice plate 14. With the functions, it is able to obtain a structure of continuously suppressing the adhesion and deposition of the ink mist onto the orifice plate 14 without stopping the printing action for recovery action on the printing head part 13. Since the deposition of ink onto the orifice plate 14 can be suppressed, the plugging of the ejection port 17 by the ink can be prevented, and the state of being incapable of ejection can be prevented. Since the printing action is not needed to stop for performing the recovery action, speed increase of the printing action is attained.

Since the ink adhering onto the orifice plate 14 can be recovered without performing recovery action of the printing head part 13, there is no need for mounting a device such as the recovery unit 10 for recovery action. Elimination of a device for recovery action is possible so that the ink jet printing apparatus 1 becomes small in size, which attains space-saving in the installation site of the ink jet printing apparatus 1. In addition, the manufacturing cost of the ink jet printing apparatus 1 can be suppressed. Furthermore, by supplying the ink recovered through the recovery hole 22 from the common liquid chamber 21 to the ejection port 17, the ink adhered to the ejection face on the orifice plate 14 opposite to the printing medium 2 can be reused. As a result, the consumption of the ink for printing in the printing head part 13 can be decreased, and the operating cost of the ink jet printing apparatus 1 equipped with the head cartridge 8 of the first embodiment can be suppressed. According to the first embodiment, the ink adhered onto the orifice plate 14 can be reused so that the amount of waste ink becomes small. Reduced amount of waste ink decreases the load to the environment, thus providing the environmentally friendly ink jet printing apparatus 1.

(Second Embodiment)

The second embodiment will be described below referring to FIG. 3. The parts which are the same to those in the first embodiment have the same respective numerals and symbols, and so further description is omitted and the description is made only to the different items from the first embodiment.

Figure 3:
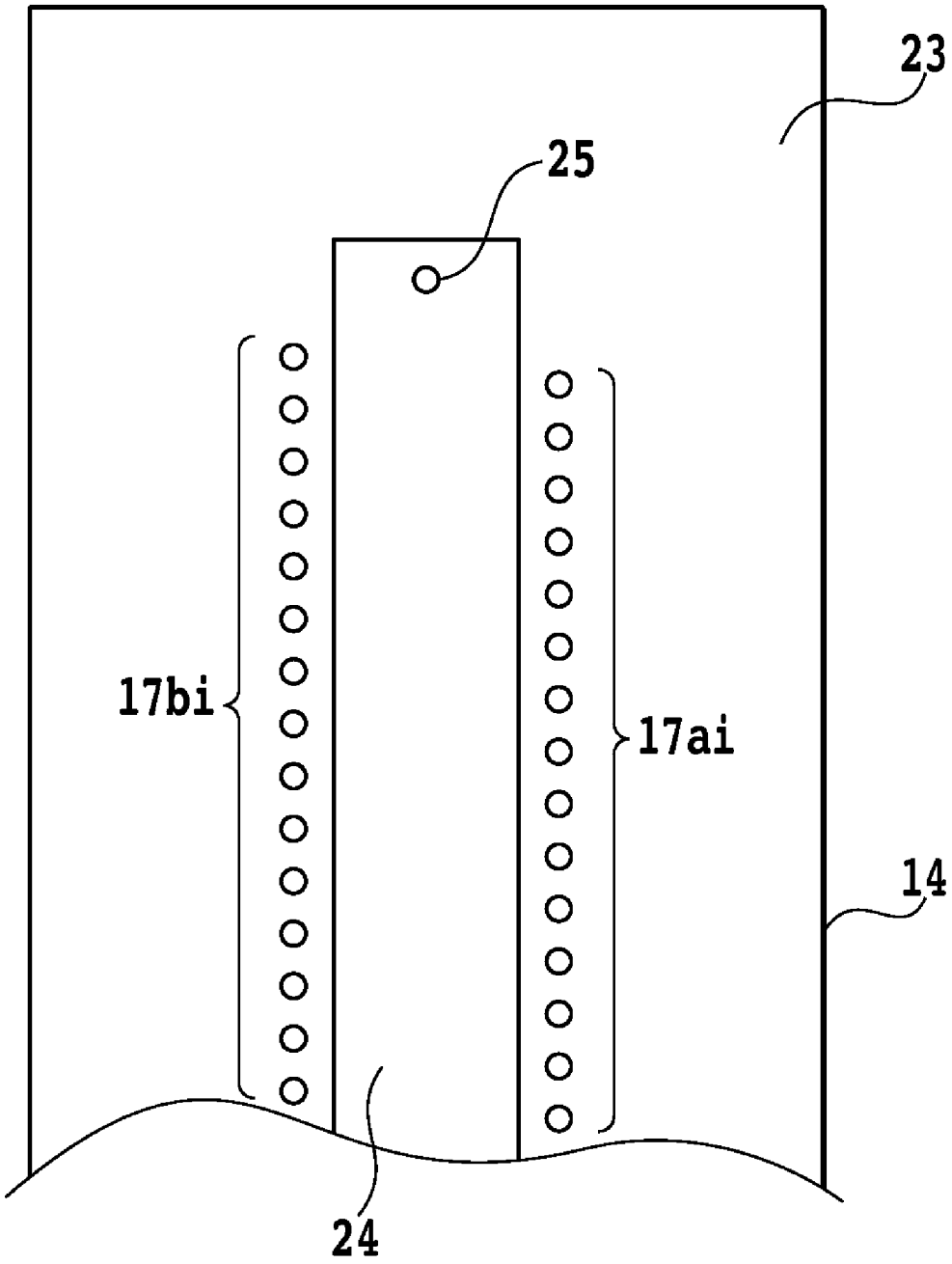
FIG. 3 shows a plan view of a printing head part of a second embodiment of the present invention, viewed from the printing medium side.

FIG. 3 shows the plan view of the face on the orifice plate 14 opposite to the printing medium 2 in the second embodiment. According to the second embodiment, although one edge part of the orifice plate 14 is not shown in FIG. 3, a recovery hole 25 is formed only at an external side of each end of the ejection port arrays 17*ai* and 17*bi* in the direction of arrangement of the ejection port arrays 17*ai* and 17*bi*. Similar to the first embodiment, the second embodiment forms the water-repellent zone 23 surrounding the ejection port arrays 17*ai* and 17*bi* and forms the non-water-repellent zone 24 between the ejection port arrays 17*ai* and 17*bi*. The ink adhered to the water-repellent zone 23 surrounding the ejection port arrays 17*ai* and 17*bi* is drawn toward the non-water-repellent zone 24. Then, the ink collected to the non-water-repellent zone 24 is recovered into the recovery hole 25. According to the second embodiment, the recovery hole 25 is formed only at two positions, each one at each end of the non-water-repellent zone 24 in the direction of arrangement of the ejection port arrays 17*ai* and 17*bi*. In the second embodiment, the ink collected in the non-water-repellent zone 24 on the orifice plate 14 is transferred along the direction of arrangement of the ejection port arrays 17*ai* and 17*bi* through the non-water-repellent zone 24 by the suction force existing in the recovery hole 25. Once the ink reaches the recovery hole 25, the ink is recovered into the recovery hole 25. The ink adhered to the ejection face on the orifice plate 14 may be recovered with a reduced number of the recovery holes 25, as in the case of the second embodiment.

(Third Embodiment)

The third embodiment will be described below referring to FIG. 4. The parts which are the same to those in the first embodiment and the second embodiment have the same respective numerals and symbols, and so further description is omitted and the description is made only to the different items from the first and the second embodiments.

Figure 4:
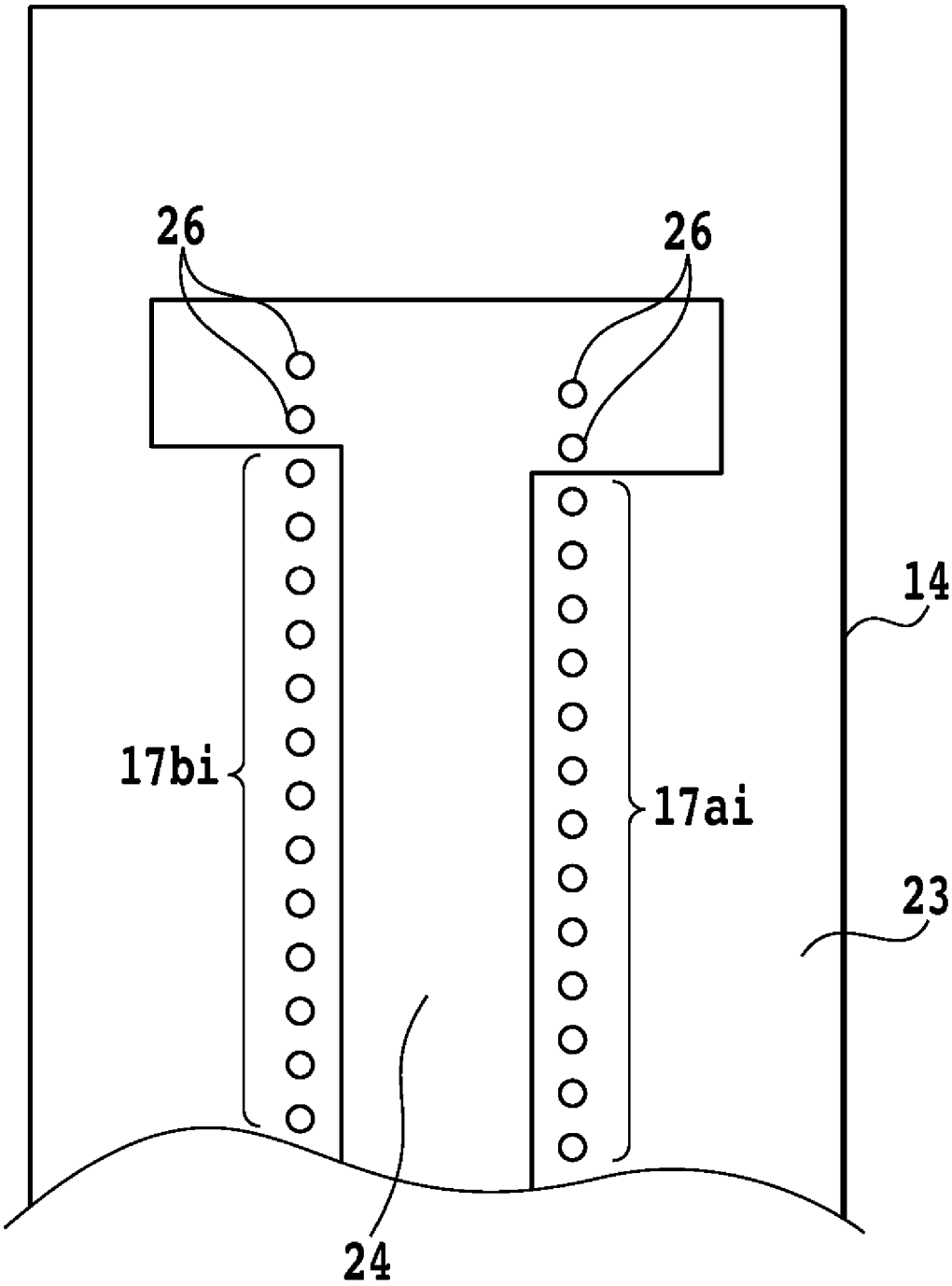
FIG. 4 shows a plan view of a printing head part of a third embodiment of the present invention, viewed from the printing medium side.

FIG. 4 shows the plan view of the face on the orifice plate 14 opposite to the printing medium 2 in the third embodiment. According to the second embodiment, a recovery hole 25 is formed only at an external side of each end of the ejection port arrays 17*ai* and 17*bi* in the direction of arrangement of the ejection port arrays 17*ai* and 17*bi*. In the third embodiment, there are formed four recovery holes 26, each two of them at the external side of each of the ejection port arrays 17*ai* and 17*bi* at the end of the orifice plate 14 of one side, as shown in FIG. 4. Although the edge part of one side of the orifice plate 14 is not shown, there are formed totally eight recovery holes 26 on both edge parts thereof.

The water-repellent zone 23 is formed at the periphery of the ejection port arrays 17*ai* and 17*bi*, and the non-water-repellent zone 24 is formed between the ejection port arrays 17*ai* and 17*bi*. Those zones are each formed as the ink-guide. The non-water-repellent zone 24 is formed in width-widened shape in the vertical direction to the direction of arrangement of the ejection port arrays 17*ai* and 17*bi* at an external position to the outermost edge of each of the ejection port arrays 17*ai* and 17*bi*. In a portion where the width of the non-water-repellent zone 24 is widened, there are formed two recovery holes 26 for each array of the ejection port arrays 17*ai* and 17*bi* on the extending line of the respective arrays at each end of the orifice plate 14. The non-water-repellent zone 24 is formed so as not to contain the ejection port arrays 17*ai* and 17*bi*.

According to the third embodiment, the recovery hole 26 is formed at a position where the ejection ports were formed in conventional pattern. Accordingly, for forming the recovery hole 26, there is no need to form a hole at a different position during the stage of manufacturing the head cartridge 8. To use the formed hole as the recovery hole 26, the heater as the energy generator is not placed at the conventionally positioned point corresponding to the conventional ejection port 17. As a result, on forming the recovery hole 26 on the orifice plate 14, it is possible to form the recovery hole 26 simultaneously with the formation of the ejection port arrays 17*ai* and 17*bi* in the patterning step similar to that of conventional method. Thus, there is no need to add a new step of forming the recovery hole 26 on the orifice plate 14, and it is possible to form the recovery hole 26 on the orifice plate 14 while suppressing the increase in the number of process steps.

(Fourth Embodiment)

The fourth embodiment will be described below referring to FIG. 5. The parts which are the same to those in the first embodiment to the third embodiment have the same respective numerals and symbols, so that further description is omitted and the description is made only to the different items from the first to the third embodiments.

Figure 5:
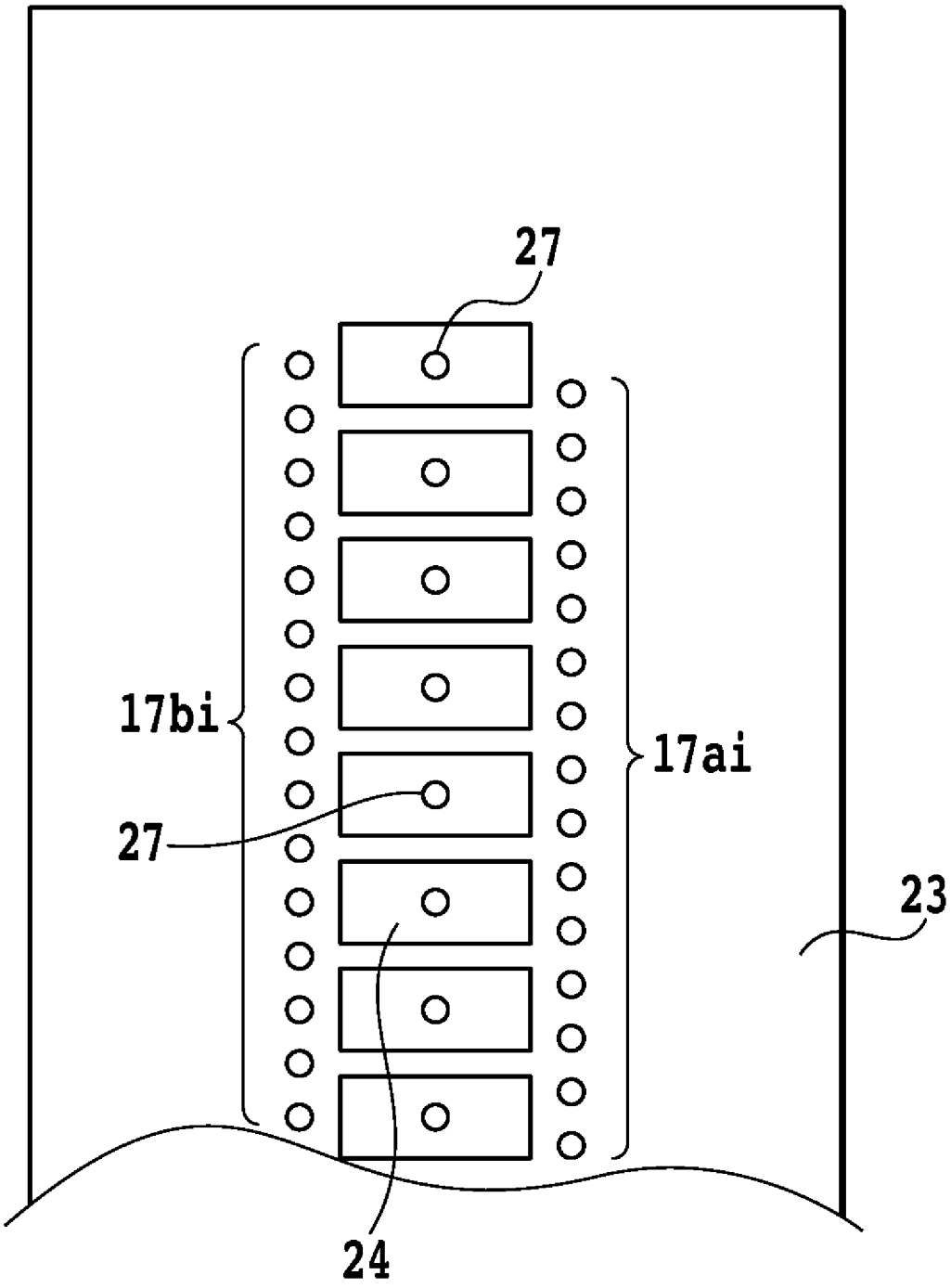
FIG. 5 shows a plan view of a printing head part of a fourth embodiment of the present invention, viewed from the printing medium side.

FIG. 5 shows the plan view of the face on the orifice plate 14 opposite to the printing medium 2 in the fourth embodiment. According to the fourth embodiment, an array of recovery holes 27 is formed between the ejection port arrays 17*ai* and 17*bi* in the same direction to the extending line of the ejection port arrays 17*ai* and 17*bi*. The non-water-repellent zone 24 is formed at the periphery of each recovery hole 27, and the water-repellent zone 23 is formed at the periphery of the ejection port arrays 17*ai* and 17*bi*. In the fourth embodiment, the non-water-repellent zone 24 is formed by one to a single recovery hole 27, and the non-water-repellent zone 24 is formed for each recovery hole 27. Thus the non-water-repellent zones 24 do not overlap with each other. The recovery holes 27 are arranged in the non-water-repellent zone 24 by a quantity equivalent to that of the formed non-water-repellent zones 24. The extending direction of each non-water-repellent zone 24 may not be completely perpendicular to the direction of the arrangement of the ejection port arrays 17*ai* and 17*bi*.

The first to the fourth embodiments describe the shape of the water-repellent zone 23 and the non-water-repellent zone 24, and the combination of the positions of the recovery holes on the orifice plate 14. They are, however, not limited to those given in the first to the fourth embodiments. Other shapes of the water-repellent zone 23 and the non-water-repellent zone 24, and other position of the recovery hole may be applicable as long as they allow the ink adhered onto the orifice plate 14 can be guided to the recovery hole and be recovered.

(Fifth Embodiment)

The fifth embodiment will be described below referring to FIG. 6 and FIG. 7. The parts which are the same to those in the first embodiment to the fourth embodiment have the same respective numerals and symbols, so that further description is omitted and the description is made only to the different items from the first to the fourth embodiments.

Figure 6:
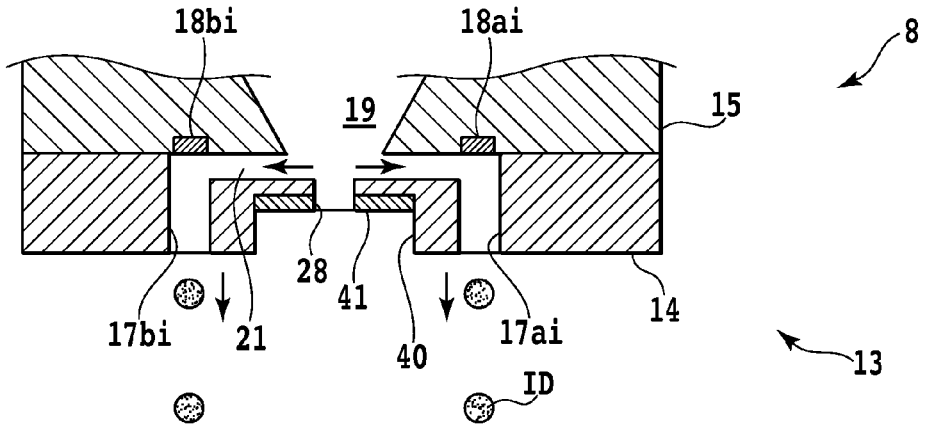
FIG. 6 shows a cross sectional view of a printing head part of a fifth embodiment of the present invention.
Figure 7:
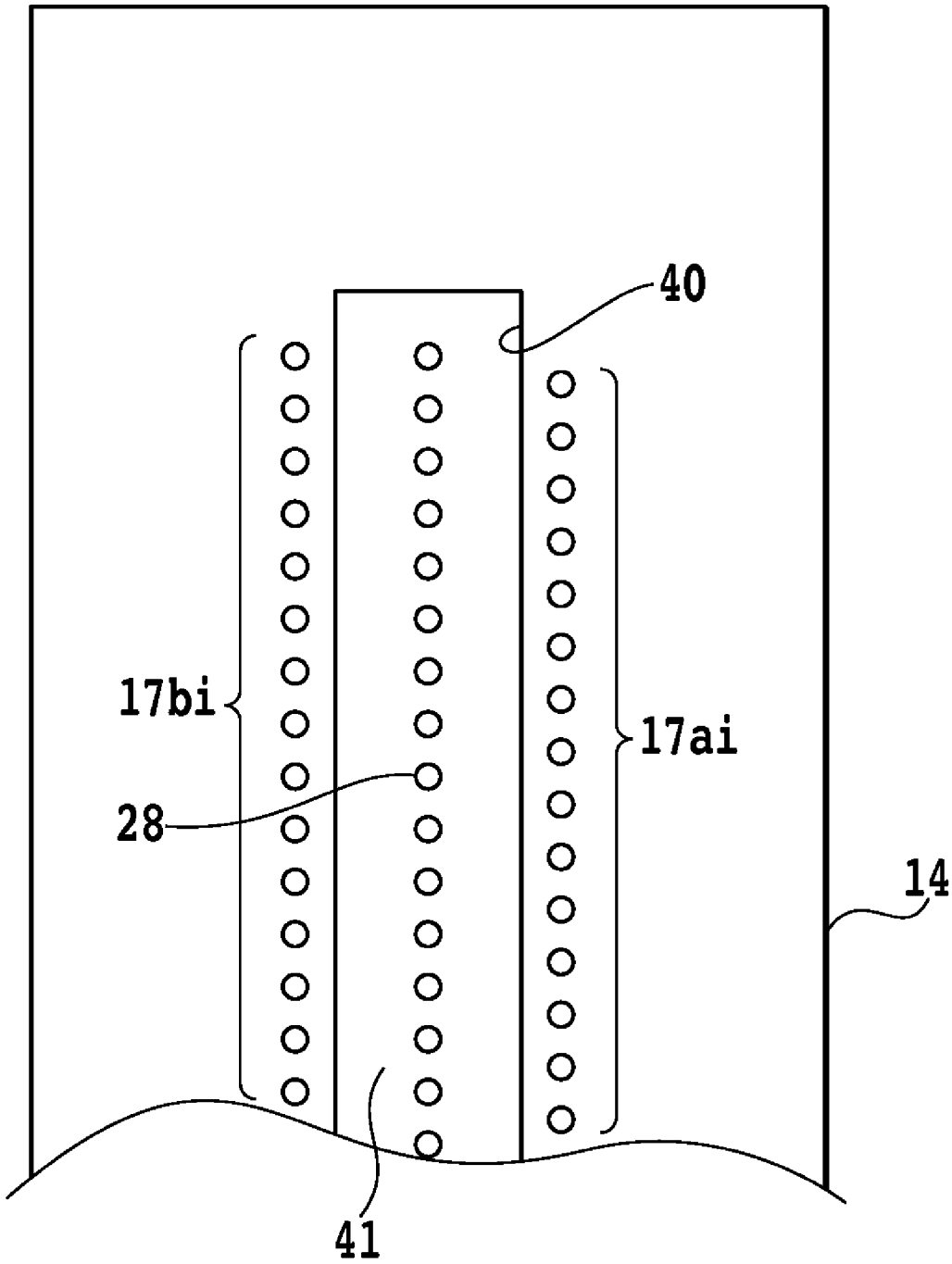
FIG. 7 shows a plan view of the printing head part of the fifth embodiment of the present invention, viewed from the printing medium side.

FIG. 6 shows a schematic cross sectional view of the main portion of the head cartridge 8 of the fifth embodiment. FIG. 6 is an enlarged view of the printing head part 13 of the head cartridge 8 in the fifth embodiment. FIG. 7 shows the plan view of the ejection face as the face of the printing head part 13 of the head cartridge 8 opposite to the printing medium 2 in the fifth embodiment.

According to the fifth embodiment, a fine slit-shaped concave portion 40 in the orifice plate 14 is formed between the ejection port arrays 17*ai* and 17*bi*. The concave portion 40 intrudes into the orifice plate 14 from the face which opposes the printing medium 2 in the orifice plate 14 toward the opposite direction from the face to the printing medium 2. On a bottom face 41, which is the face intruding into the orifice plate 14 in the concave portion 40, a recovery hole 28 communicating with the common liquid chamber 21 is formed. According to the fifth embodiment, the concave portion 40 functions as the ink-guide (function of liquid guide).

In the fifth embodiment, since the recovery hole 28 is formed on the bottom face 41 formed by the thin slit-shape concave portion 40, once a portion of the ink adhered onto the orifice plate 14 intrudes into the concave portion 40, the capillary force is applied to the ink entered in the concave portion 40. As a result, even a slight amount of ink having intruded in the concave portion 40 is totally drawn into the concave portion 40 by the capillary force acting therein. The ink drawn into the concave portion 40 then adheres to the bottom face 41 of the concave portion 40. The ink adhered to the bottom face 41 is drawn toward the recovery hole 28 by the suction force existing in the recovery hole 28, thereby being recovered into the recovery hole 28.

The surface of the concave portion 40 including the bottom face 41 according to the fifth embodiment can be the non-water-repellent zone, which is not subjected to the water-repellent treatment, and the surrounding area of the ejection port arrays 17*ai* and 17*bi* is the water-repellent zone, which is subjected to water-repellent treatment. Adding to the capillary force of the thin slit-shape concave portion 40, the difference in the wettability between the water-repellent zone and the non-water-repellent zone also makes the ink to be drawn toward the recovery hole 28, thereby enabling further efficient gathering of the ink to the surrounding area of the recovery hole 28. In the fifth embodiment, the bottom face 41 is formed as the non-water-repellent zone which is not subjected to the water-repellent treatment, and the face of the orifice plate 14 other than the bottom face 41 opposite to the printing medium 2 is formed as the water-repellent zone which is subjected to the water-repellent treatment.

Figure 8:
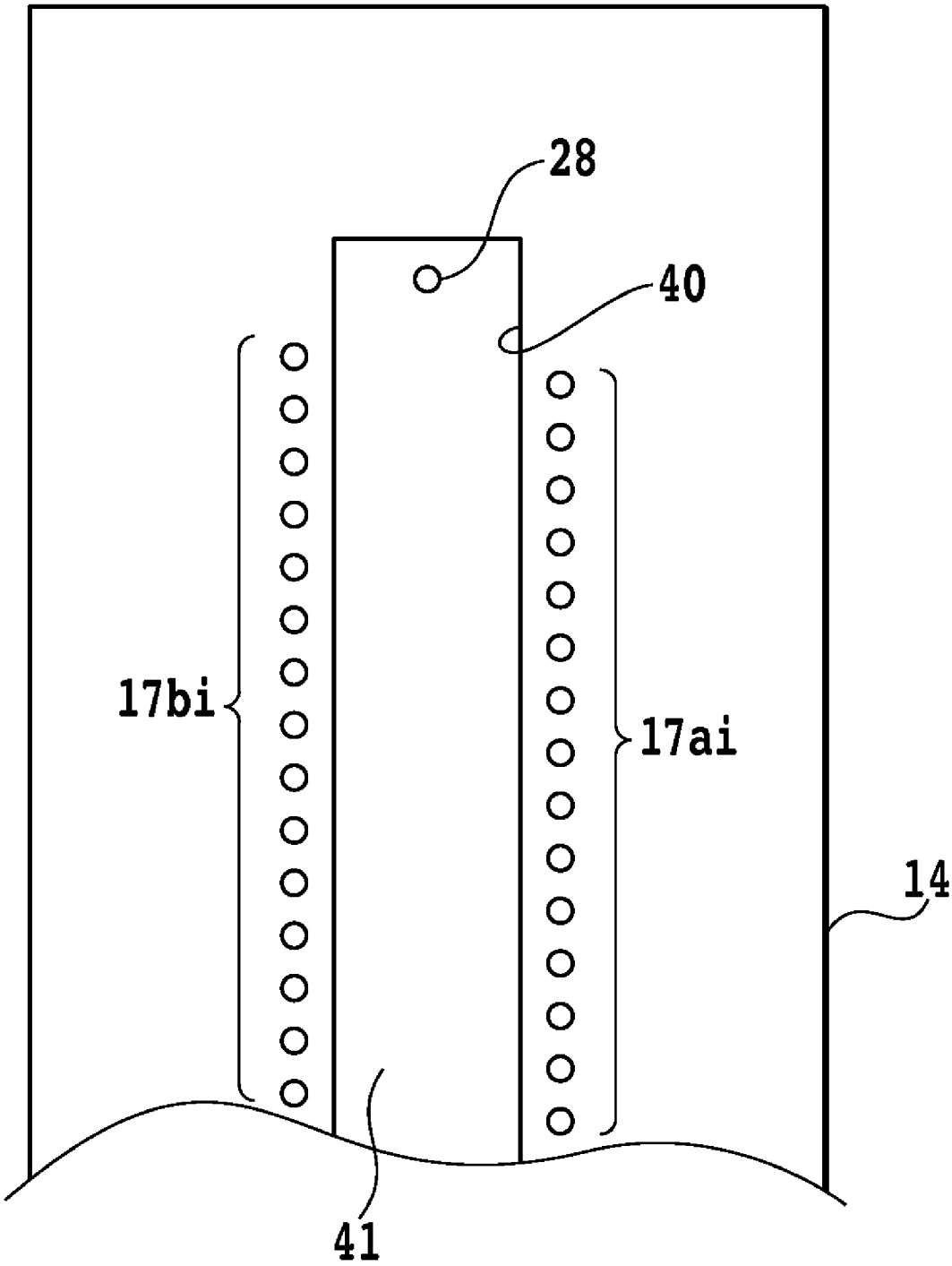
FIG. 8 shows a plan view of a printing head part of another embodiment of the present invention, viewed from the printing medium side.
Figure 9:
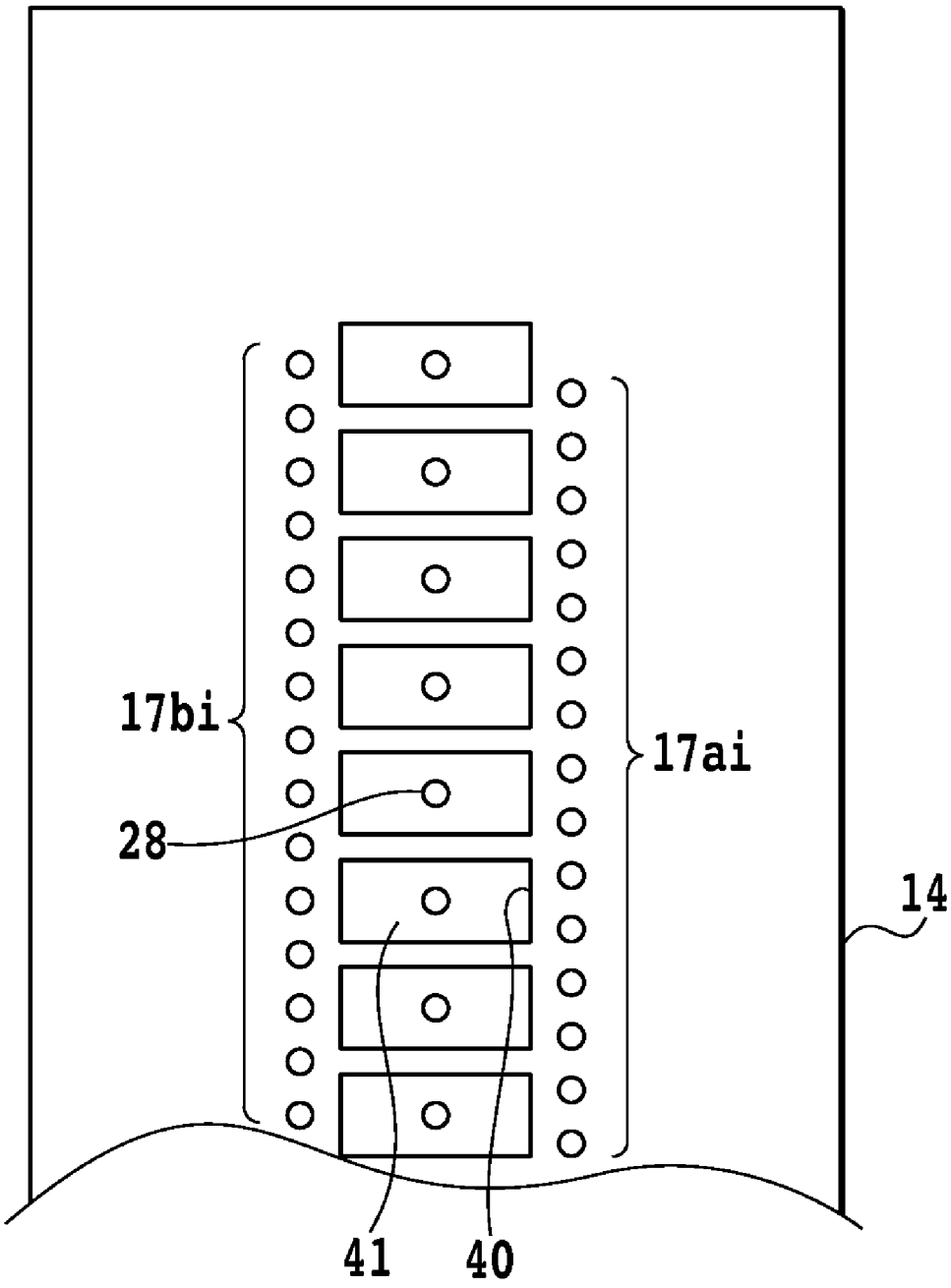
FIG. 9 shows a plan view of a printing head part of further another embodiment of the present invention, viewed from the printing medium side.

Regarding the shape of the concave portion 40 and the position of the recovery hole 28 on the orifice plate 14, they are not limited to those described in the fifth embodiment, and they may be the shape of the concave portion 40 and the position of the recovery hole 28, shown in FIG. 8 or FIG. 9. Other shapes of the concave portion 40 and the position of the recovery hole 28 than those above may be applied as long as they allow gathering of the ink to the recovery hole 28.

(Other Embodiment)

The liquid ejected from the ejection port is not limited to ink. The term "ink" or "liquid" referred to herein should be appreciated in wide meaning, and they signify the liquid which is used for forming image, design, pattern, and the like, or for processing the ink or printing medium by applying thereof onto the printing medium. Processing the ink or printing medium includes the improvement in the fixing performance through the solidification or insolubilization of coloring material in the ink applied to the printing medium, the improvement in the printing quality or color formation, and the improvement in the image durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-097716, filed Apr. 3, 2007, which is hereby incorporated by reference herein in its entirety.

What is claimed is:

1. A liquid ejection head comprising:

a plurality of ejection port arrays formed by a plurality of ejection ports ejecting liquid and arranged in row;

a liquid chamber communicating with the ejection ports and configured to contain the liquid to be supplied to the ejection ports;

a concave portion formed at a face on which the ejections ports are formed and between the plurality of ejection port arrays from one end side of the ejection port array toward an opposite side of the ejection port array;

a recovery hole formed in a bottom surface of the concave portion, one end of the recovery hole communicating with the bottom surface and one end communicating with the liquid chamber, wherein the liquid adhered to the face is recovered into the liquid chamber through the recovery hole by negative pressure existing in the liquid chamber.

2. The liquid ejection head according to claim 1, wherein the face is configured to guide the liquid adhered to the face into the recovery hole.

3. The liquid ejection head according to claim 2, further comprising a non-water-repellent zone formed at the periphery of the recovery hole, and a water-repellent zone formed at the periphery of the non-water-repellent zone, the non-water-repellent zone and the water-repellent zone are configured to guide the liquid.

* * * * *